US006995513B2

(12) United States Patent
Alderman et al.

(10) Patent No.: US 6,995,513 B2
(45) Date of Patent: Feb. 7, 2006

(54) COIL ANTENNA/PROTECTION FOR CERAMIC METAL HALIDE LAMPS

(75) Inventors: John C. Alderman, Corning, NY (US); Shiming Wu, Painted Post, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/179,320

(22) Filed: Jun. 24, 2002

(65) Prior Publication Data

US 2003/0006705 A1 Jan. 9, 2003

Related U.S. Application Data

(63) Continuation-in-part of application No. 09/851,443, filed on May 8, 2001, now Pat. No. 6,861,805.

(51) Int. Cl.
*H01J 61/06* (2006.01)

(52) U.S. Cl. ..... 313/607; 313/594; 313/234

(58) Field of Classification Search ..... 313/607, 313/234, 594, 344, 635, 25
See application file for complete search history.

(56) References Cited

U.S. PATENT DOCUMENTS

| | | | | |
|---|---|---|---|---|
| 3,742,281 | A * | 6/1973 | McInally | 313/570 |
| 3,757,159 | A * | 9/1973 | Gutta et al. | 315/47 |
| 4,004,189 | A * | 1/1977 | Cosco et al. | 315/335 |
| 4,037,129 | A * | 7/1977 | Zack et al. | 313/594 |
| 4,140,385 | A * | 2/1979 | Shaw et al. | 399/220 |
| 4,179,640 | A | 12/1979 | Larson et al. | |
| 4,491,766 | A | 1/1985 | Larson | |
| 4,507,584 | A * | 3/1985 | Coaton et al. | 313/624 |
| 4,950,938 | A | 8/1990 | Ramaiah | |
| 5,109,183 | A * | 4/1992 | Robertson et al. | 315/58 |
| 6,020,685 | A * | 2/2000 | Wei et al. | 313/625 |
| 6,087,774 | A * | 7/2000 | Nakayama et al. | 313/607 |
| 6,172,462 | B1 * | 1/2001 | Gibson et al. | 313/594 |
| 6,198,223 | B1 * | 3/2001 | Scholz | 313/623 |
| 6,326,721 | B1 * | 12/2001 | Shippee et al. | 313/283 |
| 6,392,343 | B1 * | 5/2002 | Luijks et al. | 313/570 |
| 6,400,076 | B1 * | 6/2002 | Allen et al. | 313/572 |
| 6,563,267 | B1 * | 5/2003 | Van Den Nieuwenhuizen et al. | 313/594 |
| 6,713,961 | B2 * | 3/2004 | Honda et al. | 313/607 |

FOREIGN PATENT DOCUMENTS

DE 2639276 A1 5/1977

(Continued)

OTHER PUBLICATIONS

Verderber, Rudolph writes the article "Industrial Lighting" in "Wiley Encyclopedia of Electrical and Electronics Engineering Online".*

*Primary Examiner*—Ashok Patel

(57) ABSTRACT

The invention relates to improvements in high-pressure discharge lamps of the ceramic metal halide type of the Philips MasterColor series having a metal coil wrapped around the discharge vessel and/or at least a portion of the electrode feed through means, and having power ranges of about 150W to about 1000W, wherein the lamp has a metal coil wound around the discharge vessel and/or at least a portion of the electrode feed through means in a first position and in which metal coil the coil position of at least one coil portion, preferably multiple coil portions, and most preferably substantially all of the coil portions of the metal coil are stabilized to be substantially non-relaxed from the first position after exposure to elevated temperature conditions present during operation of the lamp. The metal coil functions as both an ignition aid and for containment in said lamp.

18 Claims, 5 Drawing Sheets

FOREIGN PATENT DOCUMENTS

| | | | |
|---|---|---|---|
| EP | 0104594 | B1 | 1/1989 |
| EP | 0474277 | A1 | 3/1992 |
| EP | 0549056 | A1 | 6/1993 |
| EP | 0645800 | A1 | 3/1995 |
| EP | 1241925 | A2 | 9/2002 |
| GB | 471900 | | 3/1936 |
| WO | 0137319 | A1 | 5/2001 |

* cited by examiner

COIL ANTENNA/PROTECTION FOR CERAMIC METAL HALIDE LAMPS

RELATED APPLICATION

This application is a continuation-in-part application of U.S. Ser. No. 09/851,443 filed May 8, 2001, now U.S. Pat. No. 6,861,805 "Coil Antenna/Protection For Ceramic Metal Halide Lamps", the disclosure of which is hereby incorporated by reference.

FIELD OF THE INVENTION

The invention relates to a high-pressure discharge lamp which is provided with a discharge vessel that encloses a discharge space and includes a ceramic wall, the discharge space accommodating an electrode which is connected to an electric current conductor by means of a leadthrough element. The invention also relates to a high intensity discharge (HID) lamp having a discharge vessel light source, a glass stem, a pair of leads embedded in the glass stem, a glass envelope surrounding the light source, and a wire frame member with a first end fixed with respect to the stem, an axial portion extending parallel to the axis of the lamp, and a second end resiliently fitted in the closed end of the glass envelope.

BACKGROUND OF THE INVENTION

High intensity discharge (HID) lamps are commonly used in large area lighting applications, due to their high energy efficiency and superb long life. The existing HID product range consists of mercury vapor (MV), high pressure sodium (HPS), and quartz metal halide (MH) lamps. In recent years, ceramic metal halide lamps (for example, Philips MasterColor® series) from 39 to 400W have entered the market place. Compared to the conventional HID lamps, these ceramic metal halide lamps display excellent initial color consistency, superb stability over life, (lumen maintenance >80%, color temperature shift <200K at 10,000hrs), high luminous efficacy of >90 lumens/watt and a lifetime of about 20,000 hours. These highly desirable characteristics are due to the high stability of the polycrystalline alumina (PCA) envelopes and a special mixture of salts, which emits a continuous-spectrum light radiation close to natural light. By adjusting the composition of salts used in said lamps, color temperatures of 3800–4500K, and a Color Rendering Index (CRI) of above 85 can be achieved.

One current design of MasterColor lamps utilizes a cylindrical PCA discharge tube with extended plugs for securing electrodes. The approximate aspect ratio of the PCA discharge tube, i.e. length/diameter, of the PCA body varies from 1 to 3 for lower wattages (39W–100W), and 3 to 10 for higher wattages (150W to 1000W). For the top of the line 400W and 1000W lamps, the lamp current is approximately 4.5A (ANSI standard) in steady state operation and is approximately 7–8A during warm up. The mount structure of the high wattage MasterColor lamps include a standard glass bulb with gas filling or vacuum, stem, connectors, getters, current carrying frame wire, and ignition aids such as UV enhancer or antenna. One of the designs for antenna is a conductive coil extending along the length of barrel and wrapped around the arc tube and around the extended plugs. The antenna coil reduces the breakdown voltage at which the fill gas ionizes by a capacitive coupling between the coil and the adjacent lead-in in the plug. When an AC voltage is applied across the electrodes, the antenna stimulates UV emission in the PCA, which in turn causes primary electrons to be emitted by the electrode. The presence of these primary electrons hastens ignition of a discharge in the fill gas.

When the said lamps are in steady-state operation, the gas pressure inside the discharge vessel ranges from 2 to 20 atmospheres. Therefore, it is possible that when the discharge vessel ruptures when the lamp is in operation, the fragments becomes energized and penetrate the outer glass bulb, posing risks to the environment. Therefore, the said lamps are subject to containment tests. By "containment" is meant the prevention of outer bulb damage caused by arc tube rupture. ANSI test protocol method for measurement for containment testing of quartz metal halide lamps is published as an appendix to American National Standard for method of measurement of metal halide lamps, ANSI C78.387-1995. The Mo coil antenna in the said lamps serves a dual function as containment protection and ignition.

Protected pulse-start metal halide lamps (with both low-wattage ceramic arc tubes and low/high wattage quartz arc tubes) use a quartz sleeve and often a Mo coil wrapped around the sleeve to contain particles within the outer bulb in the event of an arc tube rupture. These lamps do not require auxiliary antenna to aid the ignition process.

Other lamps such as HPS or sodium halide lamps use a refractory metal spiral to aid in starting and to inhibit sodium migration through the arc tube during operation. Representative of such uses are:

EP 0549056 which discloses a metal coil used for containment only and not for ignition. In addition, the coil is wrapped around a sleeve that surrounds the arc tube and is not wrapped around the arc tube itself.

U.S. Pat. No. 4,179,640 which discloses a coil used for ignition only in HPS lamps and not for containment. In addition, the coil is electrically connected to the frame wire and is not capacitively coupled.

U.S. Pat. No. 4,491,766 which discloses a coil used for ignition and inhibition of sodium migration and not for containment. In addition, the coil is electrically connected to the frame wire and is not capacitively coupled.

U.S. Pat. No. 4,950,938 discloses a metal screen and not a coil, the screen is used for containment only and not for ignition.

DE 2639276 discloses a high pressure sodium vapor lamp with a cylindrical mesh grid starting aid to permit lower operational voltages.

There is a need in the art for HID lamps of the ceramic metal halide type with power ranges of about 150W to about 1000W, and for such lamps that use a metal coil for both ignition and containment.

In said co-pending application Ser. No. 09/851,443, HID lamps of the ceramic metal halide type with power ranges of about 150W to about 1000W are provided that use a metal coil wound around the arc tube of such lamps for both ignition and containment. The nominal voltage range for 150W–400W lamp types is 100V–135V, and the nominal voltage range for 1000W lamps is 250–263V. Such constructions provide numerous benefits over the prior art that were not recognized or previously achieved.

The present invention provides still further improvements in said lamps. For example, over the life of the lamp, the coiled antenna is constantly exposed in a temperature environment of above 1200 degrees C. which may tend to decrease the effectiveness of the coiled antenna as a starting aid and as a containment aid. There is a need to insure that the effectiveness of such coiled antennae is maintained while exposed to high temperature environments.

SUMMARY OF THE INVENTION

An object of the invention is to provide HID lamps of the ceramic metal halide type with power ranges of about 150W to about 1000W that use a metal coil wound around the arc tube of such lamps for both ignition and containment wherein the effectiveness of the coiled antenna as a starting aid and as a containment aid is maintained after exposure to high temperature environments over extended periods.

Another object of the invention is to provide ceramic metal halide lamps of the Philips MasterColor series that display excellent initial color consistency, superb stability over life (lumen maintenance >80%, color temperature shift <200K at 10,000 hrs), high luminous efficacy of >90 lumens/watt, a lifetime of about 20,000 hours, and power ranges of about 150W to about 1000W that use such an improved metal coil wound around the arc tube of such lamps for both ignition and containment.

These and other objects of the invention are accomplished, according to a first embodiment of the invention in which gas discharge lamps with a metal coil wound around the arc tube for both ignition and containment are provided which may be coupled with ANSI standard series of ballasts designed for high pressure sodium or quartz metal halide lamps (pulse-start or switch-start). The lamps of the invention are an extension of Philips MasterColor® series lamps to a power range of 150W to 1000W, and they are suitable for same-power HPS or MH retrofit. Therefore, they may be used with most existing ballast and fixture systems.

In its preferred embodiments, the invention provides ceramic metal halide lamps having a power range of about 150W to about 1000W, that include a metal coil wound around the arc tube in a first position and in which the coil position of at least one coil portion of the metal coil is stabilized to be substantially non-relaxed from the first position after exposure to high temperature conditions present during operation of the lamp, the metal coil being used for both ignition and containment. Such lamps are suitable for high pressure sodium and/or quartz metal halide retrofit applications.

In one preferred embodiment, power lamps as described above will have one or more and most preferably all of the following properties: a CCT (correlated color temperature) of about 3800 to about 4500K, a CRI (color rendering index) of about 70 to about 95, a MPCD (mean perceptible color difference) of about ±10, and a luminous efficacy up to about 85–95 lumens/watt.

In another preferred embodiment, ceramic metal halide lamps having a metal coil antenna as described above are provided which have been found, regardless of the rated power, to have a lumen maintenance of >80%, color temperature shift <200K from 100 to 8000, and lifetime of about 10,000 to about 25,000 hours.

Especially preferred are such ceramic metal halide lamps that display excellent initial color consistency, superb stability over life (lumen maintenance >80%, color temperature shift <200K at 10,000 hrs), high luminous efficacy of >90 lumens/watt, a lifetime of about 20,000 hours, and power ranges of about 150W to about 1000W.

In a preferred embodiment of the invention, a metal coil antenna is provided which has:

- a coiled portion wound around the arc tube in a first position and attached to a first end of the arc tube, and
- an extended, preferably straight, terminal portion attached to a second end of the arc tube, which straight terminal portion extends along a length of the coiled portion and is attached to the first end of the arc tube and is effective to stabilize at least one coil portion of the metal coil, and preferably the entire coil portion, to be substantially non-relaxed from the first position upon exposure to high temperature conditions.

In another embodiment of the invention, a metal coil antenna is provided which has:

- a coiled portion wound around the arc tube in a first position and attached to a first end of the arc tube, and
- an extended, preferably straight terminal portion attached to a second end of the arc tube, which straight terminal portion is attached to the first end of the arc tube and extends along a length of the coiled portion forming interconnections between the coils of the wound, coiled portion, and is effective to stabilize at least a portion of the metal coil, and preferably the entire coil portion, to be substantially non-relaxed from the first position upon exposure to high temperature conditions.

BRIEF DESCRIPTION OF THE DRAWINGS

The above aspects and further aspects of the lamps in accordance with the invention will be described in detail hereinafter with reference to the drawing in which.

DETAILED DESCRIPTION OF THE PREFERRED EMBODIMENTS

Figure 1:
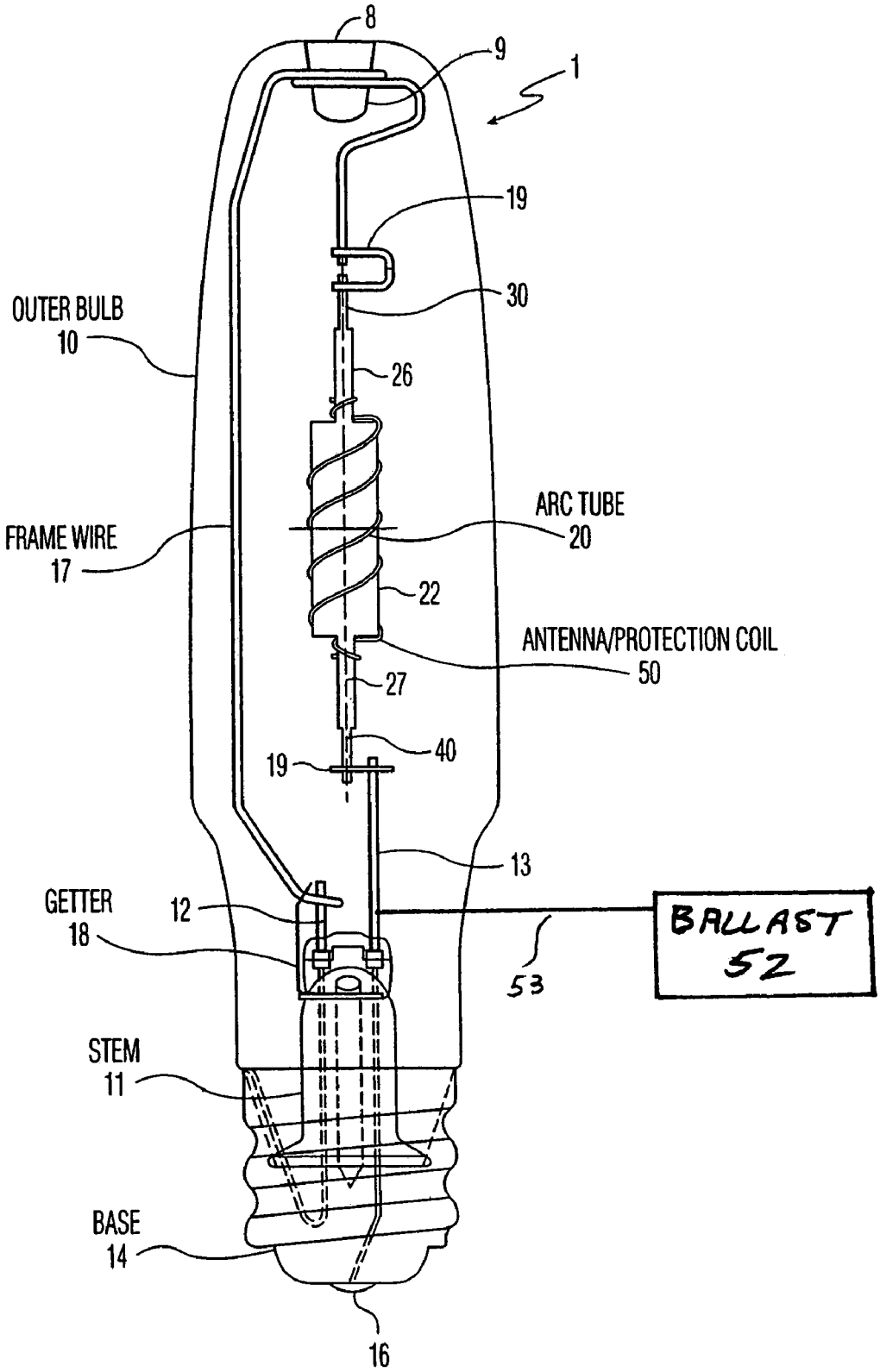
FIG. 1 is a schematic of a lamp with the coiled antenna which is currently in use and forms the subject of said co-pending application Ser. No. 09/851,443)
Figure 2A:
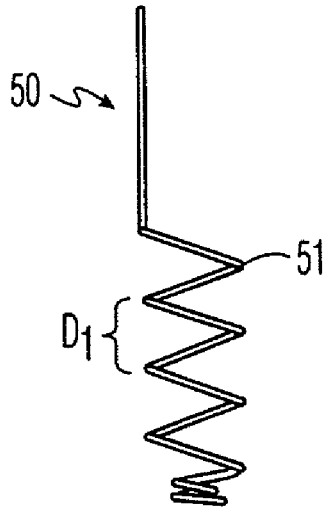
FIGS. 2A and 2B are illustrations of a relaxed coiled antenna in an unassembled and assembled form, respectively.
Figure 2B:
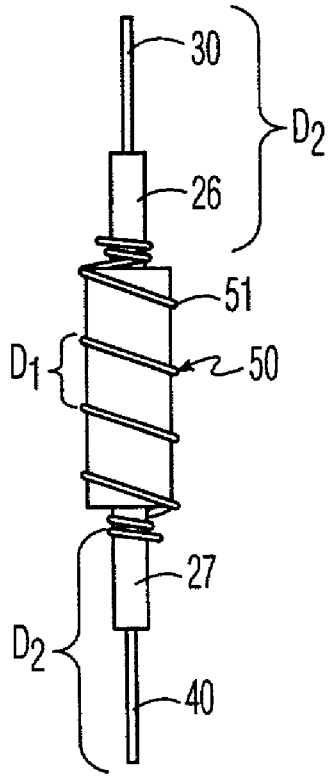
Figure 3:
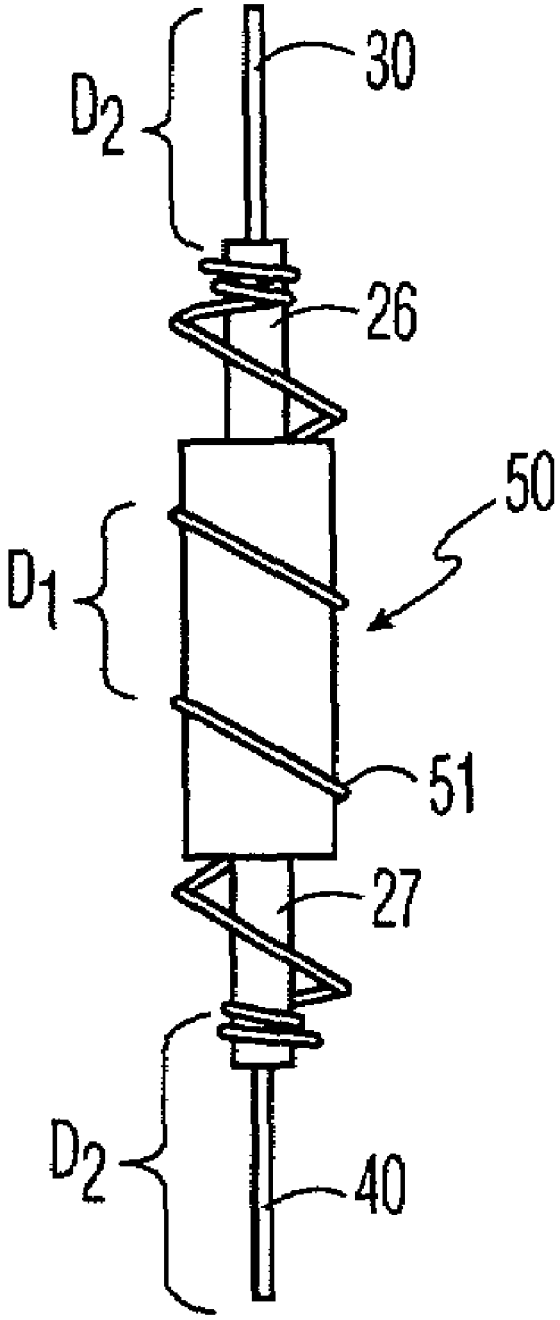
FIG. 3 is an illustration of the relaxed antenna after exposure to high heat environments over an extended time period.

Referring to FIGS. 1 to 3, a ceramic metal halide discharge lamp 1 comprises a glass outer envelope 10, a glass stem 11 having a pair of conductive frame wires 12, 13 embedded therein, a metal base 14, and a center contact 16 which is insulated from the base 14. The frame wires 12, 13 are connected to the base 14 and center contact 16, respectively, and not only support the arc tube 20 but supply current to the electrode assemblies 30, 40 via frame wire member 17. A getter 18 is fixed to the frame wire member 17 and to the frame wire 13. Niobium connectors 19 provide an electrical connection for the arc tube electrode feedthroughs 30 and 40. Beyond this the frame member 17 is provided with an end portion 9 that contacts a dimple 8 formed in the upper axial end of the glass envelope 10. Further details of the construction are given in said co-pending application Ser. No. 09/851,443 in FIGS. 9 and 10. As illustrated therein, the electrodes 30, 40 each have a lead-in 32, 42 of niobium which is sealed with a frit 33, 43 which hermetically seals the electrode assembly into the PCA arc tube, a central portion 34, 44 of molybdenum/aluminum cermet, a molybdenum rod portion 35, 45 and a tungsten tip 36, 46 having a winding 37, 47 of tungsten. The barrel 22 and end walls 24, 25 enclose a discharge space 21 containing an ionizable filling of an inert gas, a metal halide, and mercury.

As used herein, "ceramic" means a refractory material such as a monocrystalline metal oxide (e.g. sapphire), polycrystalline metal oxide (e.g. polycrystalline densely sintered aluminum oxide and yttrium oxide), and polycrystalline non-oxide material (e.g. aluminum nitride). Such materials allow for wall temperatures of 1500–1600K and resist chemical attacks by halides and Na. For purposes of the present invention, polycrystalline aluminum oxide (PCA) has been found to be most suitable.

FIGS. 1 to 3 also show a ceramic metal halide arc tube 20 having a conductive antenna coil 50 having windings or coil portions 51 extending along the length of barrel 22 and wrapped around the arc tube 20 and around the extended plugs 26,27. The antenna coil 50 reduces the breakdown voltage at which the fill gas ionizes by a capacitive coupling between the electrodes when a high voltage pulse is applied across the electrodes. An electric field is thereby induced in the PCA of the end plugs. This in turn stimulates UV emission in the PCA, which in turn causes primary electrons to be emitted by the electrode. The presence of these primary electrons hastens ignition of a discharge in the fill gas.

Such a lamp forms the subject of our co-pending application Ser. No. 09/851,443 and provides many unique and desirable properties. In such lamps, the coiled antenna 50 is preferably a length of molybdenum wire coiled around the barrel 22 of the arc tube 20 at a predetermined pitch and is terminated at each end of the arc tube where it is wrapped around the extended plugs. The wire is attached so that no electrical connection to the current carrying component in the lamps is made. The purpose of the coiled wire is to serve as a starting aid as well as arc tube containment to eliminate the possibility of bulb rupture if the arc tube explodes. Over the life of the lamp, the coiled antenna 50 is constantly exposed in a high temperature environment of, for example, 1000° C. Under these conditions, there is the possibility that the coiled shape may relax to some extent over time. As the coil relaxes under these conditions, the distance D1 between the windings or coiled portions 51 increases, and the distance D2 between the ends of the coiled antenna 50 and the electrode assemblies, which carry electric current, decreases. (See FIGS. 2 and 3).

Figure 4A:
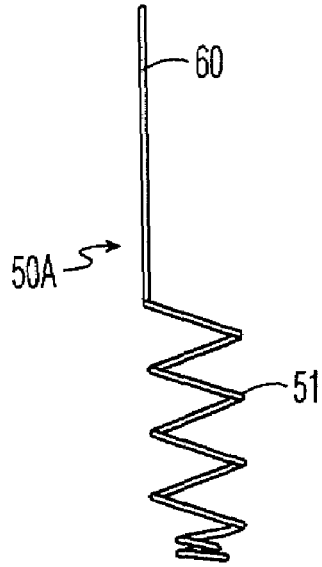
FIGS. 4A and 4B are illustrations of an embodiment of a non-relaxing coiled antenna of this invention in an unassembled and assembled form, respectively.
Figure 4B:
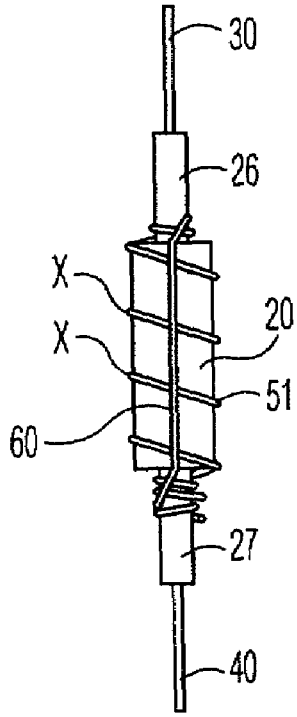

FIGS. 4 and 5 illustrate improved metal coil antennae 50A and 50B which are suitable for use in the lamps illustrated in FIG. 1 and which either eliminate or substantially diminish the problems related to relaxation of the antenna coil. According to the invention, a metal coil 50A or 50B is wound around the arc tube 20 and/or extended plugs in a first position x and in which metal coil 50A or 50B the coil position x of at least one coil portion 51 of the metal coil is stabilized to be substantially non-relaxed from the first position x after exposure to high temperature conditions present during operation of the lamp, the metal coil being used for both ignition and containment. In the embodiment illustrated in FIG. 4, a metal coil antenna 50A is provided which has:

a coiled portion 51 wound around the arc tube 20 in a first position x and attached to a first end and/or extended plug 26 of the arc tube, and an extended, preferably straight, terminal portion 60 attached to a second end and/or extended plug 27 of the arc tube, which straight terminal portion 60 extends along a length of the coil 50 and is attached to the first end or extended plug 26 of the arc tube 20 and is effective to stabilize at least one coil portion 51 of the metal coil, and preferably the entire coil 50A, to be substantially non-relaxed from the first position x upon exposure to high temperature conditions.

Figure 5A:
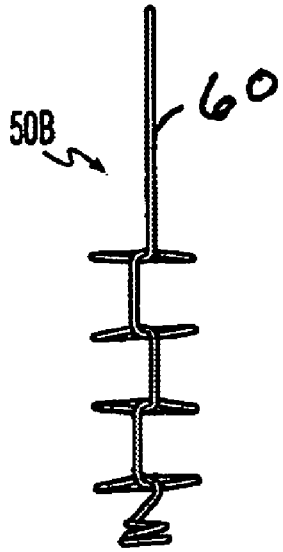
FIGS. 5A and 5B are illustrations of another embodiment of a non-relaxing coiled antenna of this invention in an unassembled and assembled form, respectively.
Figure 5B:
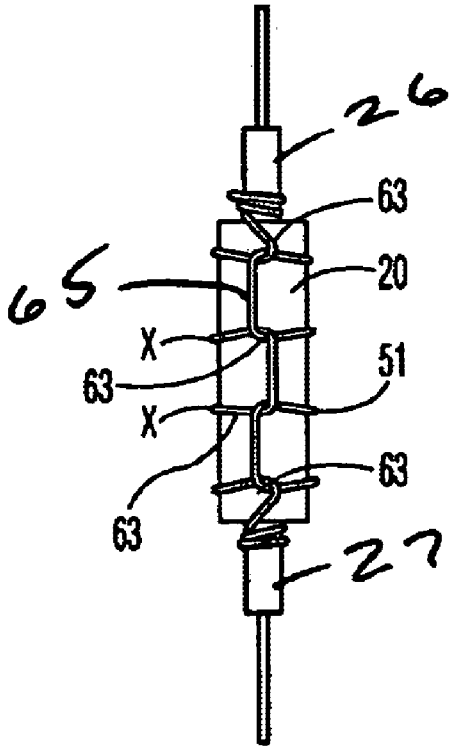

In the embodiment illustrated in FIGS. 5A and 5B, a metal coil antenna 50B is provided which has coiled portions 51 which are adapted for winding around the arc tube (FIG. 5A) and wound around the arc tube 20 in a first position x and attached to a second end and/or extended plug 27 of the arc tube (FIG. 5B), and an extended, preferably straight terminal portion 60 adapted for attachment to the arc tube (FIG. 5A), and attached to the first end and/or extended plug 26 of the arc tube (FIG. 5B). Coiled portions 51 are interconnected with connecting portions 65 formed by crossing over the coil at the transitions between the coil portions and the connecting portions, as shown in FIGS. 5A and 5B, forming interconnections 63 between the coil portions 51 of the metal coil. This arrangement is effective to stabilize at least one, preferably a plurality of the coil portions 51, and most preferably all of the coil portions of the entire coil 50B, to be substantially non-relaxed from the first position x upon exposure to high temperature conditions.

The Mo used for the coil preferably is potassium-doped and is designated HCT (high crystallization temperature). This material must withstand vacuum firing at 1300° C. and then show no cracking, splitting, delamination, or splintering when submitted to an ASTM ductility test.

Thus to summarize, there is provided high wattage discharge lamps which comprise a ceramic discharge vessel which encloses a discharge space and is provided with preferably a cylindrical-shaped ceramic, preferably a sintered translucent polycrystalline alumina arc tube with electrodes, preferably tungsten-molybdenum-cermet-niobium electrodes, attached on either side by gas-tight seals. Metallic mercury, preferably a mixture of noble gases and radioactive Kr85, and a salt mixture preferably composed of sodium iodide, calcium iodide, thallium iodide and several rare earth iodides are contained in the arc tube 20. The arc tube is protected from explosion by a molybdenum coil 50A or 50B which is wound around the arc tube 20 in a first position x and in which metal coil 50A or 50B the coil position x of at least one coil portion 51 is stabilized to be substantially non-relaxed from the first position x after exposure to high temperature conditions present during operation of the lamp. The entire arc tube and its supporting structure are enclosed in a standard-size lead-free hard glass bulb, with other components such as a getter (18 in FIG. 1) or an UV enhancer (not shown) attached as necessary. The coil antenna serves as an antenna for starting or ignition, provides good capacitive coupling for ignition, has no adverse effect on the efficacy or lifetime properties of the lamps, and also provides mechanical containment of particles in the event of arc tube rupture. The lamp may be coupled to a standard type of ballast, indicated schematically as box 52, electrically connected to frame wire 13 by lead 53.

The product family will have a wide range of usage in both indoor and outdoor lighting applications. The primary indoor applications include constantly-occupied large-area warehouse or retail buildings requiring high color rendering index, high visibility and low lamp-to-lamp color variation. Outdoor applications include city street lighting, building and structure illumination and highway lighting.

It will be understood that the invention may be embodied in other specific forms without departing from the spirit and scope or essential characteristics thereof, the present disclosed examples being only preferred embodiments thereof.

We claim:

1. A discharge lamp comprising a ceramic discharge vessel enclosing a discharge space, said discharge vessel including within said discharge space an ionizable material comprising a metal halide, a first and second discharge electrode feedthrough means, and a first and second current conductor connected to said first and second discharge electrode feedthrough means, respectively;

said lamp having a metal coil wound in a continuous series of loops around the discharge vessel and/or at least a portion of the electrode feed through means in a first position, the metal coil having coil portions, each coil portion composed of a single loop which extends entirely around the discharge vessel and/or the electrode feed through means, the metal coil also having at least one extended terminal portion which extends along a length of the coil portions, whereby the coil position of the at least one coil portion is stabilized to be substantially non-relaxed from the first position after exposure to elevated temperature conditions present during operation of the lamp, said metal coil functioning as both an ignition aid and for containment in said lamp.

2. A lamp as claimed in claim 1, wherein the metal coil comprises:

a plurality of coil portions wound around the discharge vessel in a first position and attached to the discharge vessel and/or electrode feedthrough means at a first end of the discharge vessel, and the extended terminal portion is attached to the discharge vessel and/or feedthrough means at a second end of the discharge vessel, which extended terminal portion extends along a length of the coil portions and is attached to the discharge vessel or feedthrough means at a first end of the discharge vessel, whereby said extended terminal portion is effective to stabilize at least multiple coil portions of the metal coil to be substantially non-relaxed from the first position upon exposure to high temperature conditions.

3. A lamp as claimed in claim 2, wherein the extended terminal portion is effective to stabilize all of the coil portions of the metal coil to be substantially non-relaxed from the first position upon exposure to high temperature conditions.

4. A lamp as claimed in claim 1, wherein the metal coil comprises:

a plurality of coil portions wound around the discharge vessel in a first position and attached to the discharge vessel and/or electrode feedthrough means at a first end of the discharge vessel, and the extended terminal portion is attached to the discharge vessel and/or feedthrough means at a second end of the discharge vessel, which terminal portion extends along a length of the coil portions forming interconnections between the coil portions and is attached to the discharge vessel or feedthrough means at a first end of the discharge vessel, whereby said extended terminal portion is effective to stabilize at least multiple coil portions of the metal coil to be substantially non-relaxed from the first position upon exposure to high temperature conditions.

5. A lamp as claimed in claim 4, wherein said extended terminal portion is effective to stabilize all of the coil portions of the metal coil to be substantially non-relaxed from the first position upon exposure to high temperature conditions.

6. A lamp as claimed in claim 1, wherein the lamp is a metal halide discharge lamp having a power range of about 150W to about 1000W.

7. A lamp as claimed in claim 6, which exhibits one or more of a characteristic selected from the group consisting of a CCT (correlated color temperature) of about 3800 to about 4500K, a CRI (color rendering index) of about 70 to about 95, a MPCD (mean perceptible color difference) of about +10, and a luminous efficacy up to about 85–95 lumens/watt.

8. A lamp as claimed in claim 7, retrofit with ballasts designed for high pressure sodium or quartz metal halide lamps.

9. A discharge lamp having a power range of about 150W to about 1000W and comprising a ceramic discharge vessel enclosing a discharge space, said discharge vessel including within said discharge space an ionizable material comprising a metal halide, a first and second discharge electrode feedthrough means, and a first and second current conductor connected to said first and second discharge electrode feedthrough means, respectively;

wherein the ceramic discharge vessel includes an arc tube comprising:

a cylindrical barrel having a central axis and a pair of opposed end walls, a pair of ceramic end plugs extending from respective end walls along said axis, a pair of lead-ins extending through respective end plugs, said lead-ins being connected to respective electrodes which are spaced apart in said central barrel, wherein the electrode feedthrough means each have a lead-in of niobium which is hermetically sealed into the arc tube, a central portion of molybdenum/aluminum cermet, a molybdenum rod portion and a tungsten tip having a winding of tungsten, and wherein said lamp has a molybdenum coil wound in a continuous series of loops around the arc tube and/or at least a portion of the ceramic end plugs, and/or at least a portion of the electrode feed through means in a first position, the molybdenum coil having coil portions, each coil portion composed of a single loop which extends entirely around the arc tube and/or the ceramic end plugs, the molybdenum coil also having an extended terminal portion which extends along a length of the coil portions, whereby the coil position of at least one coil portion is stabilized to be substantially non-relaxed from the first position after exposure to high temperature conditions present during operation of the lamp.

10. A lamp as claimed in claim 9, wherein the molybdenum coil is wrapped around a substantial portion of the arc tube and around at least a portion of the ceramic end plugs.

11. A lamp as claimed in claim 9, wherein the molybdenum coil comprises:

a plurality of coil portions wound around the discharge vessel in a first position and attached to the discharge vessel and/or electrode feedthrough means at a first end of the discharge vessel, and an extended terminal portion attached to the discharge vessel and/or feedthrough means at a second end of the discharge vessel, which terminal portion extends along a length of the coil portions and is attached to the discharge vessel or feedthrough means at a first end of the discharge vessel, said extended terminal portion being effective to stabilize at least multiple coil portions of the molybdenum coil to be substantially non-relaxed from the first position upon exposure to high temperature conditions.

12. A lamp as claimed in claim 11, wherein said extended terminal portion is effective to stabilize substantially all of the coil portions of the molybdenum coil to be substantially non-relaxed from the first position upon exposure to high temperature conditions.

13. A lamp as claimed in claim 9, wherein the molybdenum coil comprises:

a plurality of coil portions wound around the discharge vessel in a first position and attached to the discharge vessel and/or electrode feedthrough means at a first end of the discharge vessel, and the extended terminal portion attached to the discharge vessel and/or feedthrough means at a second end of the discharge vessel, which terminal portion extends along a length of the coil portions forming interconnections between the coil portions and is attached to the discharge vessel or feedthrough means at a first end of the discharge vessel, said extended terminal portion being effective to stabilize at least multiple coil portions of the molybdenum coil to be substantially non-relaxed from the first position upon exposure to high temperature conditions.

14. A lamp as claimed in claim 13, wherein said extended terminal portion is effective to stabilize at least substantially all of the coil portions of the molybdenum coil to be substantially non-relaxed from the first position upon exposure to high temperature conditions.

15. A discharge lamp comprising a ceramic discharge vessel enclosing a discharge space, said discharge vessel including within said discharge space an ionizable material comprising a metal halide, a first and second discharge electrode feedthrough means, and a first and second current conductor connected to said first and second discharge electrode feedthrough means, respectively;

said lamp having a metal coil wound in a continuous series of loops around the discharge vessel and/or at least a portion of the electrode feed through means in a first position, the metal coil having coil portions, each composed of a single loop which extends entirely around the discharge vessel, the metal coil also having at least one connecting portion interconnecting at least two of the coil portions, whereby the coil position of the at least one coil portion is stabilized to be substantially non-relaxed from the first position after exposure to elevated temperature conditions present during operation of the lamp, said metal coil functioning as both an ignition aid and for containment in said lamp.

16. A discharge lamp as claimed in claim 15, wherein the connecting portion and the coil portion are interconnected by a cross-over of the coil at the transition between the coil portion and the connecting portion.

17. A metal coil antenna for a discharge lamp comprising:

a plurality of coil portions for winding around a discharge vessel and/or electrode feedthrough means at a first end of the discharge vessel, and at least one connecting portion interconnected to at least one coil portion, said connecting portion being effective when assembled on a discharge vessel to stabilize at least multiple coil portions of the metal coil to be substantially non-relaxed from the first position upon exposure to high temperature conditions, wherein the connecting portion and the coil portion are interconnected by a cross-over of the coil at the transition between the coil portion and the connecting portion.

18. A metal coil antenna for a discharge lamp which comprises:

a plurality of coil portions for winding around a discharge vessel and/or electrode feedthrough means at a first end of the discharge vessel, and at least one connecting portion interconnected to at least one coil portion by a cross-over of the coil at the transition between the coil portion and the connecting portion, said connecting portion being effective when assembled on a discharge vessel to stabilize at least multiple coil portions of the metal coil to be substantially non-relaxed from the first position upon exposure to high temperature conditions.

* * * * *